US005900890A

United States Patent [19]

Mitchell

[11] Patent Number: 5,900,890

[45] **Date of Patent: * May 4, 1999**

[54] FLUID PURGE APPARATUS AND METHOD FOR INK JET PRINTER PEN

[75] Inventor: Robert T. Mitchell, Philomath, Oreg.

[73] Assignee: Hewlett-Packard Company, Palo Alto, Calif.

[ * ] Notice: This patent is subject to a terminal disclaimer.

[21] Appl. No.: 09/030,658

[22] Filed: Feb. 25, 1998

Related U.S. Application Data

[63] Continuation of application No. 08/533,130, Sep. 25, 1995.

[51] Int. Cl.[6] ..... B41J 2/165

[52] U.S. Cl. ..... 347/28

[58] Field of Search ..... 347/28

[56] References Cited

U.S. PATENT DOCUMENTS

| | | | |
|---|---|---|---|
| 3,076,607 | 2/1963 | Cordier | 239/132 |
| 4,362,572 | 12/1982 | Wallace | 134/18 |
| 5,199,470 | 4/1993 | Goldman | 141/1 |
| 5,329,294 | 7/1994 | Ontawar et al. | 397/87 |
| 5,621,445 | 4/1997 | Fong | 347/87 |
| 5,793,389 | 8/1998 | Mitchell | 347/28 |

FOREIGN PATENT DOCUMENTS

| | | | |
|---|---|---|---|
| 635371A2 | 7/1994 | European Pat. Off. | B41J 2/165 |
| 58-96563 | 10/1982 | Japan | B41J 3/04 |
| 62-90252 | 10/1985 | Japan | B41J 3/04 |

*Primary Examiner*—Benjamin R. Fuller
*Assistant Examiner*—Michael S. Brooke

[57] ABSTRACT

A service apparatus for servicing an ink jet pen having a housing defining an ink reservoir and including a print head connected to the housing in communication with the reservoir. The apparatus includes an elongated probe having first and second passages, a fluid supply conduit in communication with the first passage, a drain conduit in communication with the second passage, a fluid receptacle separate from the probe, and a vacuum source in communication with the receptacle. The apparatus may be operated by connecting a pen to the fluid conduit to provide fluid communication between the conduit and the reservoir, draining ink from the reservoir through the fluid conduit, generating a flow of rinse fluid into the reservoir, draining the rinse fluid from the reservoir; and expelling ink through the print head.

20 Claims, 2 Drawing Sheets

FLUID PURGE APPARATUS AND METHOD FOR INK JET PRINTER PEN

CROSS REFERENCE TO RELATED APPLICATION

This is a continuation of copending application Ser. No. 08/533,130 filed on Sep. 25, 1995.

FIELD OF THE INVENTION

This invention relates to ink jet printer pens, and more particularly to apparatus and methods for filling, emptying, and analyzing ink jet pens.

BACKGROUND AND SUMMARY OF THE INVENTION

Ink jet printers employ ink jet pens for generating an image on printer media. Pens normally include a housing defining a chamber filled with liquid ink, and a print head attached to the housing in communication with the chamber. The print head has a multitude of independently addressable orifices for expelling small droplets of ink onto the media. If one of the orifices should become clogged by a particle from within the chamber, the pen is considered to have failed. Such failures may be analyzed to determine the source of the contaminant particle, providing an opportunity to address a possible source of contamination introduced during pen manufacturing. Conventional failure analysis techniques have required aggressive measures to dismantle failed ink jet pens. A passage for draining ink must be formed, typically by cutting away a housing seal with a knife. Then, the ball cork must be pressed into the pen. A vent hole is created in the pen housing with a soldering iron to relieve the vacuum that would be generated as ink drains. The vent hole size is critical, as it must be large enough to admit sufficient air, yet not so large as to damage the ink-containing reservoir inside the housing. Such a process requires repeated cleaning and purging of a drain tube and a vent tube to reduce unwanted ink spillage. Also, the use of sharp or heated tools presents safety risks to personnel.

These disadvantages are overcome or reduced by providing a service apparatus for servicing an ink jet pen having a housing defining an ink reservoir and including a print head connected to the housing in communication with the reservoir. The apparatus includes an elongated probe having first and second passages, a fluid supply conduit in communication with the first passage, a drain conduit in communication with the second passage, a fluid receptacle separate from the probe, and a vacuum source in communication with the receptacle. The apparatus may be operated by connecting a pen to the fluid conduit to provide fluid communication between the conduit and the reservoir, draining ink from the reservoir through the fluid conduit, generating a flow of rinse fluid into the reservoir, draining the rinse fluid from the reservoir; and expelling ink through the print head.

DETAILED OF A PREFERRED EMBODIMENT

Figure 1:
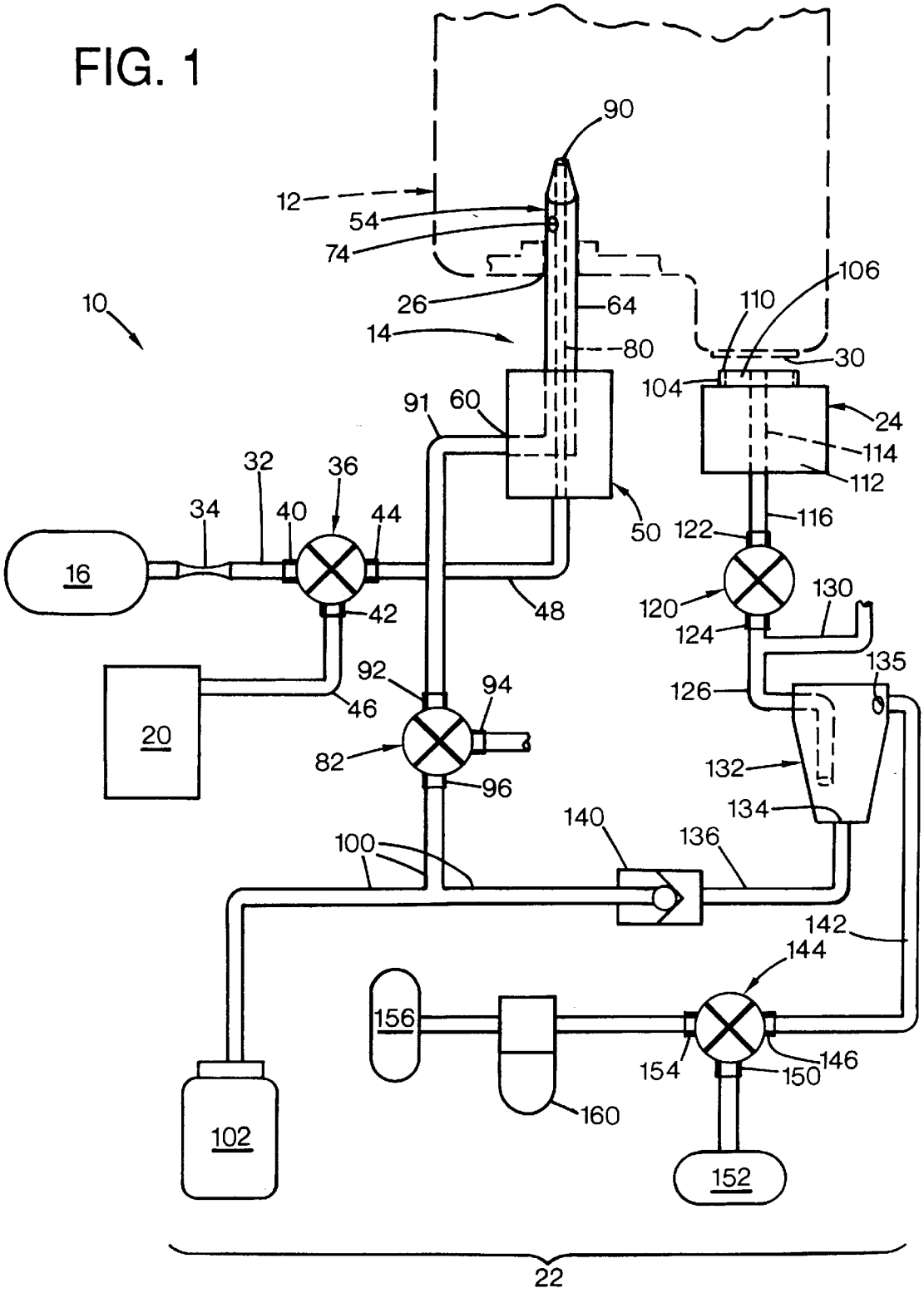
FIG. 1 is a schematic view of a fluid purge apparatus according to a preferred embodiment of the invention.

FIG. 1 shows a fluid purge system 10 for servicing an ink jet pen 12. The system 10 includes a probe assembly 14 connected to an air supply 16 and a water supply 20. A waste collection system 22 is connected to the probe assembly 14 and to a collection boot assembly 24. The ink jet pen defines an inlet orifice 26 and a includes a print head 30. The pen may be serviced for quality inspection, failure analysis, or refilling preparation by inserting the probe into the orifice 26, and placing the print head 30 near the collection boot. Air is injected into the pen to displace and drain ink, and rinse fluid may similarly be injected and drained via the probe. Waste ink and rinse fluid may be drawn away from the print head via the collection boot.

The air supply provides low pressure air at about 1.2 atmospheres (3 PSI) to the system. It communicates with a supply valve 36 via an air conduit 32 having a flow restrictor 34. The supply valve is a three way valve having an air inlet 40, to which conduit 32 is connected, a water inlet 42, and a common outlet 44. The valve has a normal position in which the air inlet is connected to the outlet, and the water inlet is closed. The water supply 20, preferably pressurized to less than about 1.2 atmospheres (3 PSI), is connected via a water conduit 46 to the water inlet 42. A supply conduit 48 extends from the valve outlet 44 to the probe assembly.

Figure 2:
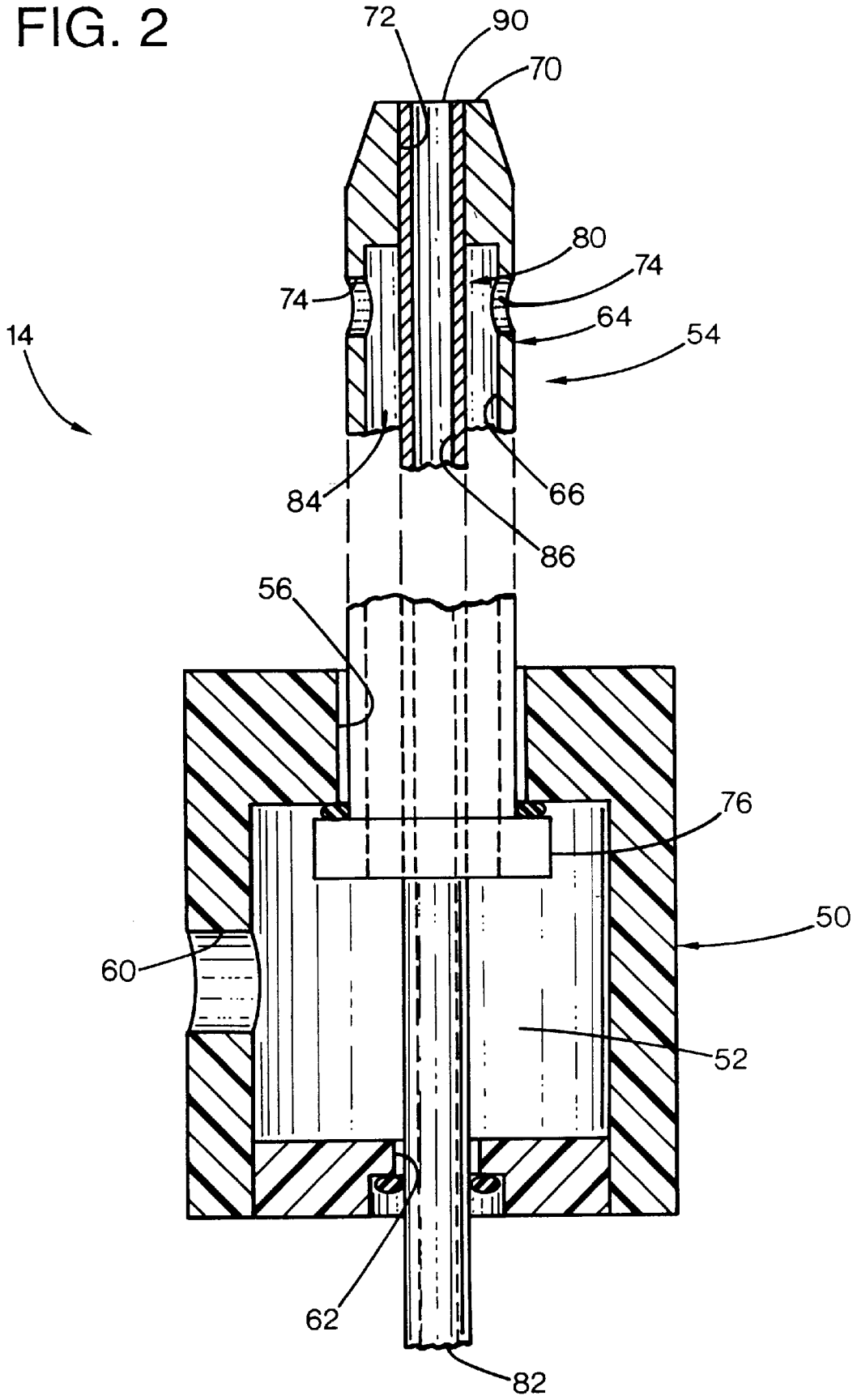
FIG. 2 is an enlarged sectional view of a probe according to the embodiment of FIG. 1.

As shown in FIG. 2, the probe assembly includes a manifold block 50 defining a manifold chamber 52, and an upwardly extending rigid elongated probe 54. The block 50 defines an upper aperture 56, a side outlet aperture 60, and a lower inlet aperture 62, all communicating with the chamber.

The probe 54 includes an outer tube 64 defining a bore 66 and terminating at a tapered free end 70. At the free end, the interior diameter is stepped down to a reduced bore 72. Near the free end, the outer tube 64 defines a pair of lateral aperture 74 providing avenues for fluid flow between the interior and exterior of the tube 64. Opposite the free end 70, a base end 76 of the outer tube 64 is sealably connected to the block 50 so that the interior of the tube 64 communicates with the chamber 52. An inner tube 80 extends coaxially within the outer tube 64 from the free end 70, beyond the outer tube's base end 76, and through block aperture 62 to protrude from the block at a lower free end 82. The outer diameter of the inner tube is sized equal to or slightly larger than the inner diameter of the reduced bore 72 to provide a sealed press fit with the outer tube. With the outer diameter of the inner tube being significantly smaller than the inner diameter of the bore 66, an outer passage 84 having an annular cross section is defined between the tube walls. The outer passage 84 provides fluid communication between the lateral aperture and the manifold block chamber 52. As the inner tube 80 is sealed with an O-ring to the lower aperture 62 of the block, fluid passing through the inner bore or passage 86 of tube 80 will not mix with fluid passing through the outer passage 84. The inner and outer passages are entirely independent of each other as they pass through the probe assembly to prevent any mixing between fluids passing through the respective passages.

Referring back to FIG. 1, the supply conduit 48 is connected to the lower end 82 of the inner tube 80 so that fluid or air provided by the supply tube will be ejected from an exit aperture 90 at the tip of the probe. A probe drain conduit 91 is connected to the probe block outlet aperture 60, and extends downward to a probe drain valve 92. The drain valve 82 is a three way valve having a drain inlet 92 connected to the drain conduit 91, a vent inlet 94 that vents to atmosphere, and a common outlet 96. The drain inlet 92 is normally open and in communication with outlet 96, while the vent 94 is normally closed. A waste conduit 100 extends from the outlet 96, and empties into a waste receptacle 102.

The collection boot assembly 24 provides for the collection and suction of fluid from the orifices in the print head 30 of the pen 12. The boot includes an elastomeric curb 104 defining a basin 106 and having a level upper surface 110. The basin 106 is sufficiently large to encompass all orifices of the print head 30. The boot assembly 24 includes a rigid base 112 supporting the curb and defining a boot drain passage 114 extending downward from the basin to a first boot drain conduit 116. A two way boot drain valve 120 has an inlet 122 connected to the boot drain conduit, and an outlet 124 connected to a second boot drain conduit 126. An optional conduit 130 may be connected to the second boot drain conduit 126 in a system for servicing multiple pens, such that it connects to the boot drain systems of additional pen service stations.

The second boot drain conduit 126 extends into a containment vessel 132, with the conduit 126 terminating near the lower portion of the vessel 132. The vessel defines a drain aperture 134 at the vessel's lowest portion, and defines a vacuum aperture 135 at the vessel's upper perimeter. A drain conduit 136 extends from the drain aperture 134, via a check valve 140, to the waste conduit 100. The check valve permits fluid flow from the vessel 132 to the waste conduit 100, but permits the waste conduit to be at a higher pressure than the vessel without fluid flow through the check valve.

A vacuum/air conduit 142 extends from the vacuum aperture 135 of the vessel 132 to a three way vacuum valve 144. The vacuum valve has a common port 146 connected to the vacuum/air conduit 142, an air inlet 150 connected to a supply of low pressure air 152, and a vacuum port 154 connected to a vacuum source 156 via a mist filter 160. In the preferred embodiment, the air supplies 16 and 152 are combined as a single supply; the illustrated embodiment is shown as having separate supplies for drawing clarity. The vacuum valve is normally in a state with the vacuum port connected to the common port 146; the valve is switchable to close the vacuum port and connect the air inlet 150 to the common port.

In the preferred embodiment, the probe's outer tube 64 has a length of about 100 mm (4 in.), and protrudes from the block 50 by about 50 mm (2 in.) The outer tube 62 has an outside diameter of about 4.76 mm (0.187 in.) and an inside diameter (at bore 66) of 3.5 mm (0.136 in.) Reduced bore 72 has a diameter of 2.4 mm (0.095 in.) The inner tube 80 has a length of 140 mm (5.5 in.), an outside diameter of 2.4 mm (0.095 in.), and an inside diameter of 2.16 mm (0.085 in.)

Operation

A pen is serviced by being placed over the probe, with the probe being inserted fully into the orifice 26. During the insertion, the probe will penetrate a seal tape (not shown) that normally covers the pen's inlet orifice 26, and will push aside a ball cork (not shown) that normally blocks the orifice from within the interior of the pen. The ball cork is a small metal sphere that has been force fit into the somewhat deformable material of the housing, and which will be further forced along into the pen reservoir upon insertion of the probe. When fully inserted, the pen's print head 30 is positioned in close proximity to the boot assembly 24 to form a seal with the curb 104. In the initial quiescent state, valve 36 is connected to the air supply 16, valve 82 is connected to drain, valve 120 is open, and valve 144 is connected to vacuum 156. With the quiescent state having the air supply connected to the probe, air will flow from the probe's exit aperture 90, thereby generating a pressure in the pen immediately upon insertion. Consequently, ink within the pen will flow into the probe's lateral apertures 74, down through the outer passage 84, and via conduit 91, valve 82, and conduit 100 to the waste receptacle 102.

While this occurs, some ink will drain from the print head 30 into the basin 106. The vacuum source 156 draws air through valve 144 and conduit 142 to generate a partial vacuum in the containment vessel 132. This suction will draw ink from the basin 106 through valve 120 into the vessel. As long as the ink quantity received is less than the vessel's capacity, the vacuum will not draw fluid from the vessel. The high level of the vacuum aperture 135 and low terminus of conduit 26 in the vessel ensures that ink will not splash into the vacuum conduit 142.

After the pen is largely drained of ink, the pen is rinsed by switching valve 36 to connect the pressurized water supply 20 to conduit 48, thereby injecting rinse fluid into the pen through the probe orifice 90 while draining waste fluid collected at apertures 74 to the waste receptacle 102. As the boot drain remains connected to vacuum, some rinse fluid may expelled by the print head and collected in the basin 106. When rinsing is complete, valve 36 is switched back to pressurized air to displace the remaining rinse fluid from the pen.

After the rinse fluid is largely drained, the pen is pressurized by switching valve 82 to vent, thereby closing inlet to prevent air from escaping the pen via the probe. This forces any additional fluid in the pen out of the print head orifices to be collected by the vacuum at the boot. Switching the valve 82 to vent allows any remaining fluid in conduit 100 to drain into the waste receptacle 102.

Then, the emptied and rinsed pen may be removed from the apparatus for inspection, particularly to determine the presence and nature of any orifice-clogging contaminants accumulated at the interior of the print head. The apparatus is then readied for subsequent use by emptying the contents of the containment vessel 132 to the waste receptacle. To do so, valve 82 remains switched to vent to avoid back pressure build up in the waste receptacle, valve 120 is closed to prevent any flow toward the boot from the containment vessel 132, and valve 144 is switched to supply the containment vessel with pressurized air from the air supply 152. This creates sufficient air pressure on top of the fluid in the vessel to force the fluid down through drain 134, past check valve 140, and into the waste receptacle. The valves are then reset to the original quiescent state for servicing of the next pen.

The apparatus and method described may be used other than for pen cleaning for failure analysis. For instance, the apparatus may be used to prepare suitable pens for refilling with ink by draining the old ink and rising the reservoir, so that new ink may be injected in a subsequent operation. While the apparatus and method are described in terms of a preferred embodiment, the following claims are not intended to be so limited.

What is claimed is:

1. A method of servicing an ink jet pen having a housing defining an ink supply reservoir with a housing aperture communicating with the reservoir, and including a print head connected to the housing and spaced apart from the housing aperture, the method comprising the steps:

connecting a fluid conduit to the reservoir by way of the housing aperture;

draining ink from the reservoir by way of the fluid conduit;

generating a flow of rinse fluid into the reservoir by way of the fluid conduit;

draining the rinse fluid from the reservoir by way of the fluid conduit; and expelling ink by way of the print head.

2. The method of claim 1 wherein connecting a fluid conduit comprises inserting an elongated probe through the housing aperture.

3. The method of claim 1 including generating a flow of displacement fluid into the reservoir while draining ink.

4. The method of claim 3 wherein generating a flow of displacement fluid comprises injecting gas into the reservoir.

5. The method of claim 1 wherein draining the rinse fluid from the reservoir comprises injecting gas into the reservoir.

6. The method of claim 1 wherein expelling ink through the print head comprises injecting gas into the reservoir.

7. The method of claim 1 wherein expelling ink through the print head comprises applying a vacuum to a receptacle adjacent to the print head.

8. The method of claim 1 including at least partially dismantling the pen for conducting a failure analysis of the pen.

9. The method of claim 8 including removing and inspecting the print head for particulate contamination.

10. A method of conducting a failure analysis of an ink jet pen having a housing with a connected print head, and the housing defining an ink supply reservoir external to the print head and in fluid communication therewith, the housing defining a fluid aperture apart from the print head, the method comprising the steps:

draining ink from the reservoir by way of the fluid aperture;

generating a flow of rinse fluid into the reservoir;

draining the rinse fluid from the reservoir;

expelling ink from the reservoir through the print head; and inspecting the pen for contaminants.

11. The method of claim 10 wherein the step of inspecting includes removing the print head from the housing and inspecting the print head for particulate contamination.

12. The method of claim 10 wherein the draining steps include generating a flow of gas into the reservoir.

13. A method of servicing an ink jet pen having a housing defining an ink supply reservoir, with a print head connected to the housing, and the housing defining a fluid aperture separate from the print head, the method comprising the steps:

pressurizing the reservoir;

draining at least some of the ink from the reservoir by way of the fluid aperture; and draining at least some of the ink from the reservoir by way of the print head.

14. The method of claim 13 including flowing a rinse fluid into the reservoir.

15. The method of claim 14 including draining at least some of the rinse fluid by way of the fluid aperture, and draining at least some of the rinse fluid by way of the fluid aperture.

16. The method of claim 13 wherein pressurizing the reservoir includes flowing a displacement fluid into the reservoir by way of the fluid aperture.

17. The method of claim 16 including simultaneously flowing the displacement fluid into the reservoir by way of the fluid aperture while draining ink by way of the fluid aperture.

18. The method of claim 16 wherein the displacement fluid is a gas.

19. The method of claim 13 wherein connecting a fluid conduit comprises inserting an elongated probe through the fluid aperture.

20. The method of claim 13 wherein draining at least some of the ink from the reservoir by way of the print head comprises applying a vacuum to a receptacle adjacent to the print head.

* * * * *